US008122734B2

(12) United States Patent
Buchstab et al.

(10) Patent No.: US 8,122,734 B2
(45) Date of Patent: Feb. 28, 2012

(54) REFRIGERATOR COMPRISING A DISPENSING DEVICE

(75) Inventors: Martin Buchstab, Bopfingen (DE); Irene Dumkow, Sontheim (DE); Adolf Feinauer, Giengen (DE); Klaus Flinner, Zöschingen (DE); Bernd Heger, Haunsheim (DE); Peter Nalbach, Kirchheim/Nabern (DE); Kasim Yazan, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 724 days.

(21) Appl. No.: 12/226,379

(22) PCT Filed: Apr. 2, 2007

(86) PCT No.: PCT/EP2007/053187

§ 371 (c)(1),
(2), (4) Date: Oct. 16, 2008

(87) PCT Pub. No.: WO2007/118787

PCT Pub. Date: Oct. 25, 2007

(65) Prior Publication Data

US 2009/0071184 A1 Mar. 19, 2009

(30) Foreign Application Priority Data

Apr. 19, 2006 (DE) ..... 10 2006 018 204

(51) Int. Cl.
*F25D 3/00* (2006.01)

(52) U.S. Cl. ..... 62/389; 62/398

(58) Field of Classification Search ..... 62/389, 62/298, 398, 259.1; 312/401, 236; 222/146.6
See application file for complete search history.

(56) References Cited

U.S. PATENT DOCUMENTS

| | | | | |
|---|---|---|---|---|
| 3,476,295 | A | 11/1969 | Telfer | |
| 4,970,874 | A * | 11/1990 | Solak et al. | 62/258 |
| 5,297,400 | A | 3/1994 | Benton et al. | |
| 5,442,933 | A | 8/1995 | Unger | |
| 5,564,808 | A * | 10/1996 | Gipson et al. | 312/405 |
| 5,659,927 | A * | 8/1997 | Shanok et al. | 16/412 |
| 6,052,933 | A * | 4/2000 | Lytle | 40/711 |
| 7,048,123 | B2 * | 5/2006 | Xiong et al. | 206/470 |
| 7,073,876 | B2 * | 7/2006 | Wing et al. | 312/204 |
| 7,082,777 | B2 * | 8/2006 | Becke et al. | 62/246 |
| 7,501,594 | B2 * | 3/2009 | Fulton et al. | 200/51 R |

(Continued)

FOREIGN PATENT DOCUMENTS

| | | |
|---|---|---|
| EP | 0 603 518 | 6/1994 |
| GB | 2 246 195 | 1/1992 |
| WO | WO 2007/062951 | 6/2007 |

OTHER PUBLICATIONS

International Search Report PCT/EP2007/053187.

*Primary Examiner* — Mohammad Ali
(74) *Attorney, Agent, or Firm* — James E. Howard; Andre Pallapies

(57) ABSTRACT

A refrigerator is provided that includes a housing and a dispensing device for flowable and/or pourable chilled material, the dispensing device being located in a front recess of the housing. The front of the housing is covered at least in part by an adjustable decorative plate. The recess is accessible through a hole in the decorative plate while a case that is open towards the dispensing device and the hole of the decorative plate is adjustably mounted in the recess.

20 Claims, 3 Drawing Sheets

U.S. PATENT DOCUMENTS

2003/0209018 A1* 11/2003 Becke et al. ..... 62/126
2004/0181985 A1* 9/2004 Ogden ..... 40/600
2004/0182103 A1 9/2004 Jung
2004/0183414 A1* 9/2004 Kwon ..... 312/401
2005/0268638 A1 12/2005 Voglewede et al.
2006/0071014 A1* 4/2006 Xiong et al. ..... 221/282

* cited by examiner

REFRIGERATOR COMPRISING A DISPENSING DEVICE

BACKGROUND OF THE INVENTION

The present invention relates to a refrigerator with a housing and a dispensing device on the front side of the housing for flowable and pourable chilled items such as in particular ice and chilled water. Such refrigerators are enjoying increasing popularity with users.

Refrigerators are also in demand which can be built in, i.e. their door can be fitted with a decorative panel whose design features match the fronts of adjacent furniture or equipment. In order to be able to align such a decorative panel precisely to the adjacent fronts it is usually adjustable in several spatial directions in relation to the door to which it is fitted.

If a dispensing device for ice or water is installed in the door of a refrigerator covered with a decorative panel the problem arises that the decorative panel must not block access to the dispensing device. If in order to provide access to the dispensing device a window is cut in the decorative panel, however, the window moves in relation to the dispensing device when the decorative panel is adjusted. If, as is usually the case, the dispensing device is installed in a recess on the front side, the recess and the window may not completely overlap, or parts of the front side may be visible between the edges of the recess and those of the window in different widths depending on the adjustment. It is therefore difficult to create a visually attractive transition between the door and the decorative panel in the area of the dispensing device.

A known possibility of avoiding these problems is to place the dispensing device in an area on the front side not belonging to the door and not to have any decorative panel in this area. This solution is unsatisfactory, however, because as parts of the refrigerator remain visible it does not actually constitute a built-in unit and, in addition, it leads to poor utilization of space in the refrigerator because not all of the front side of the refrigerator can be opened.

BRIEF SUMMARY OF THE INVENTION

The object of the invention is to create a refrigerator with a dispensing device arranged in a recess on the front side of its housing which is suitable to be covered with a decorative panel and to create an attractive transition between the recess and the decorative panel despite the decorative panel being adjustable.

The object is achieved in that on a refrigerator with a housing and a dispensing device for flowable and/or pourable chilled items arranged in a recess on the front side of the housing, which is covered at least partially by an adjustable decorative panel, the recess is accessible through an opening in the decorative panel and a case which is open towards the dispensing device and the opening of the decorative panel is fastened adjustably in the recess. As the side walls of such a case conceal the side walls of the recess from view for a person standing in front of the refrigerator and the position of the case can be adjusted to match the position of the decorative panel, an attractive appearance can be ensured for the refrigerator despite the decorative panel being adjustable.

An adjustable fastening of the case in the recess is preferably achieved by using screws inserted in a slot made in a wall of the case which engage in a thread in a wall of the recess opposite said wall of the case. Such a slot makes it possible to adjust the case in relation to the recess in at least one spatial direction.

The screws are preferably inserted in the slots with play in two directions which are orthogonal to each other in order to make the case adjustable in these two directions, whereby they clamp the wall of the case preferably between said wall of the recess and a washer.

In order to be able to fasten the case also in various positions in relation to a direction vertical to the plane of the wall of the case through which the screw is inserted, the walls of the case and of the recess preferably run towards each other at an acute angle and a wedge is clamped between the walls.

To ensure that the wedge does not slip under the pressure of the screw, preferably at least one surface of the wedge and one surface of one of the walls touched by it are complementarily toothed.

For reasons of stability it is advantageous if the wedge exhibits a drilled hole through which one of the screws is inserted. The drilled hole can be open-edged.

In order to be able to position the wedge conveniently, it is also expedient if it is rail-guided on one of the walls, preferably on the wall of the case.

In addition, the case should exhibit an opening through which the wedge is accessible so that it can be moved when the case is placed in the recess.

The walls through which the screw is inserted or which exhibit the thread can be any walls of the case and of the recess but preferably are rear walls of the same because then the screws fastening the case can be handled more conveniently than, for instance, screws in the bottom walls of the case and recess. The bottom or side walls or ceilings of the recess and the case do not have to be screw-fastened, in particular if the case is supported on the opening of the decorative panel.

An engagement of the case in the opening of the decorative panel not only makes it possible to support the case on the decorative panel but also facilitates its adjustment to match the position of the decorative panel.

A gap usually present between edges of the opening on the decorative panel and the area of the case engaging in the opening can be filled by an inserted frame.

A frame fastened on the case by insertion in the gap or in some other way can cover an edge area of the decorative panel surrounding the opening so that the gap is not visible from the outside.

To make it possible to adapt to decorative panels of different thickness the frame can be composed of several rings consecutively arranged in the depth direction of the recess.

Control elements for the dispensing device are expediently integrated in the case. As a result, the position of the control elements is variable in relation to the dispensing device, but this does not cause any difficulties, especially if the control elements generate electrical signals for controlling the dispensing device.

BRIEF DESCRIPTION OF THE DRAWINGS

Further features and advantages of the invention derive from the following description of exemplary embodiments with reference to the attached figures, which are as follows.

DETAILED DESCRIPTION OF THE PRESENT INVENTION

Figure 1:
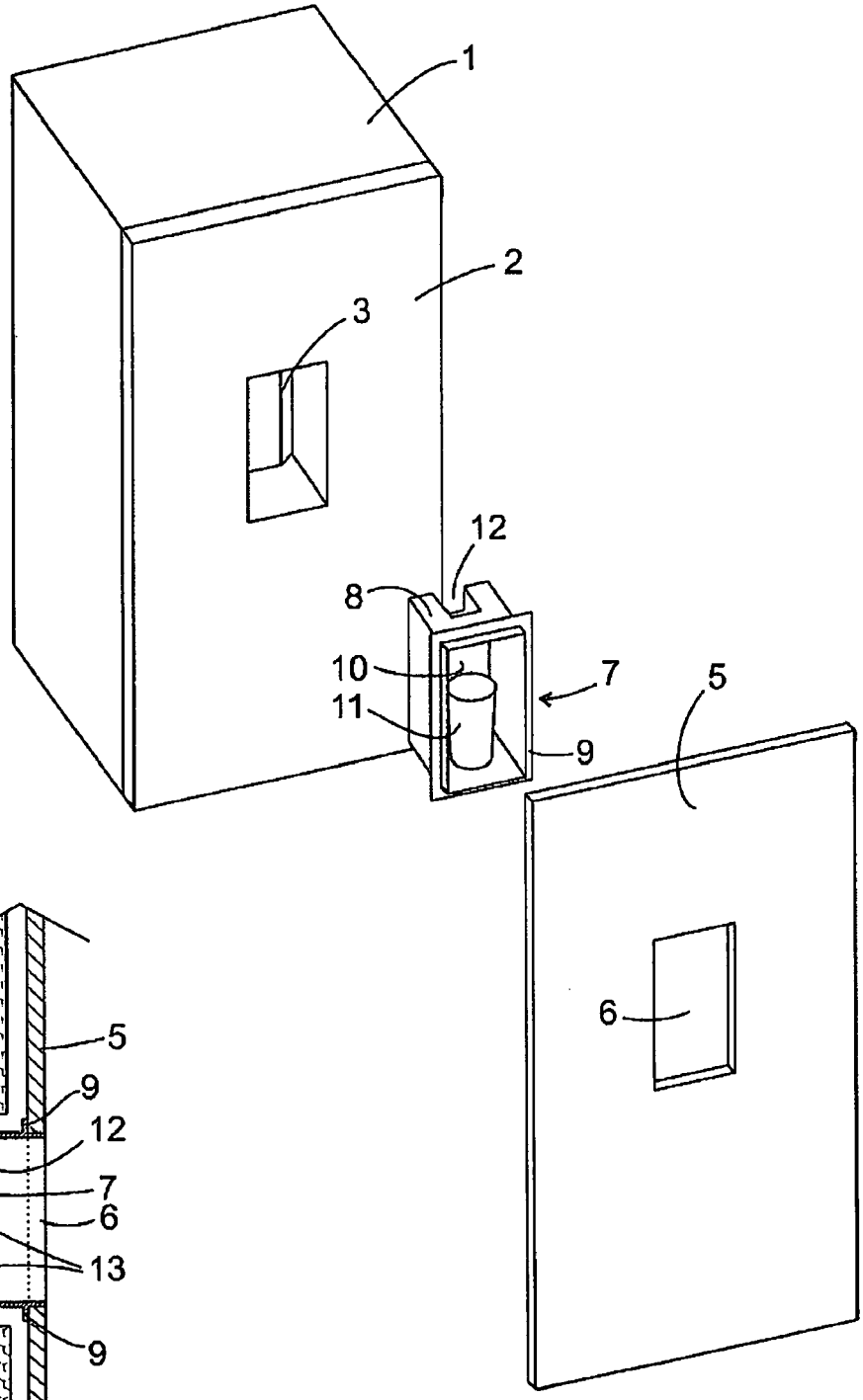
FIG. 1 is an exploded perspective view of a refrigerator with a dispensing device, a case and a decorative panel in accordance with the invention.

FIG. 1 shows a perspective view of a refrigerator such as a cabinet refrigerator, a freezer or a refrigerator-freezer combination with a body 1 and a door hinged onto the body 1 forming the entire front side of the unit. Inside the unit there is an automatic ice maker and a water tank which, as they are known per se, are not described here. A dispensing device for ice from the ice maker and water from the tank is located on the ceiling of a recess 3 which is formed centrally in door 2. The dispensing device is not visible in FIG. 1.

The door 2 is designed to be covered with a decorative panel 5. On its rear side not visible in the figure the decorative panel 5 is provided with fittings so that it can be suspended on door 2 vertically and adjustably in terms of the width and depth direction of the body 1. As suitable fittings are to the person skilled in the art, they require no further description here.

The edge lengths of the decorative panel 5 are slightly longer than those of the door 2. The oversize of the decorative panel 5 is selected depending on the freedom for adjustment of the decorative panel 5 in the vertical direction as well as in the width direction so that in each possible position of the decorative panel 5 the door 2 is completely covered by it.

The decorative panel 5 has a central cutout 6 which is located in front of the recess 3 when the decorative panel 5 is fitted to the door 2. The edge lengths of the rectangular cutout 6 roughly match the dimensions of the recess 3 in height and width direction.

An adapter 7, which e.g. can be made as a single plastic part, encloses a case 8 of rectangular cross section whose edge lengths are shorter than the corresponding dimensions of the cutout 6 or of the recess 3 by the freedom for adjustment in height and width direction of the decorative panel 5 in relation to the door 2.

From the outer sides of the case 8 a rim 9 projects which serves as a stop for fastening the adapter 7, as will be explained in more detail later.

The case 8 is closed by a rear wall 10 and has the purpose of accommodating a container 11 to be filled with water or ice. In the top side and the rear wall 10 of the case 8 there is a cutout 12 through which the dispensing device can fill the container 11.

Figure 2:
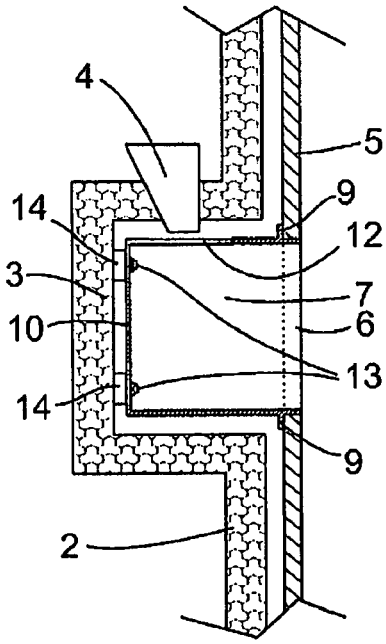
FIG. 2 is a schematic vertical cross section through the door of the refrigerator in FIG. 1 in the installed and adjusted condition.

FIG. 2 shows a partial cross section through the door 2 and the decorative panel 5 in the area of the recess 3. In the ceiling of the recess a spout of the dispensing device 4 can be seen through which water and ice can be filled into the container 11 (not shown in FIG. 2) placed in the case 8. The position of the adapter 7 in relation to the recess 3 is determined by the fact that the rim 9 rests against the rear side of the decorative panel 5 and a section of the case 8 projects forward beyond the rim 9 and engages in the cutout 6 of the decorative panel. The adapter 7 is fastened in this position by means of four screws 13 each of which is inserted through a slot in each corner of the rear wall 10 and a wedge 14 and engages in a thread in the rear wall of the recess 3.

Figure 3:
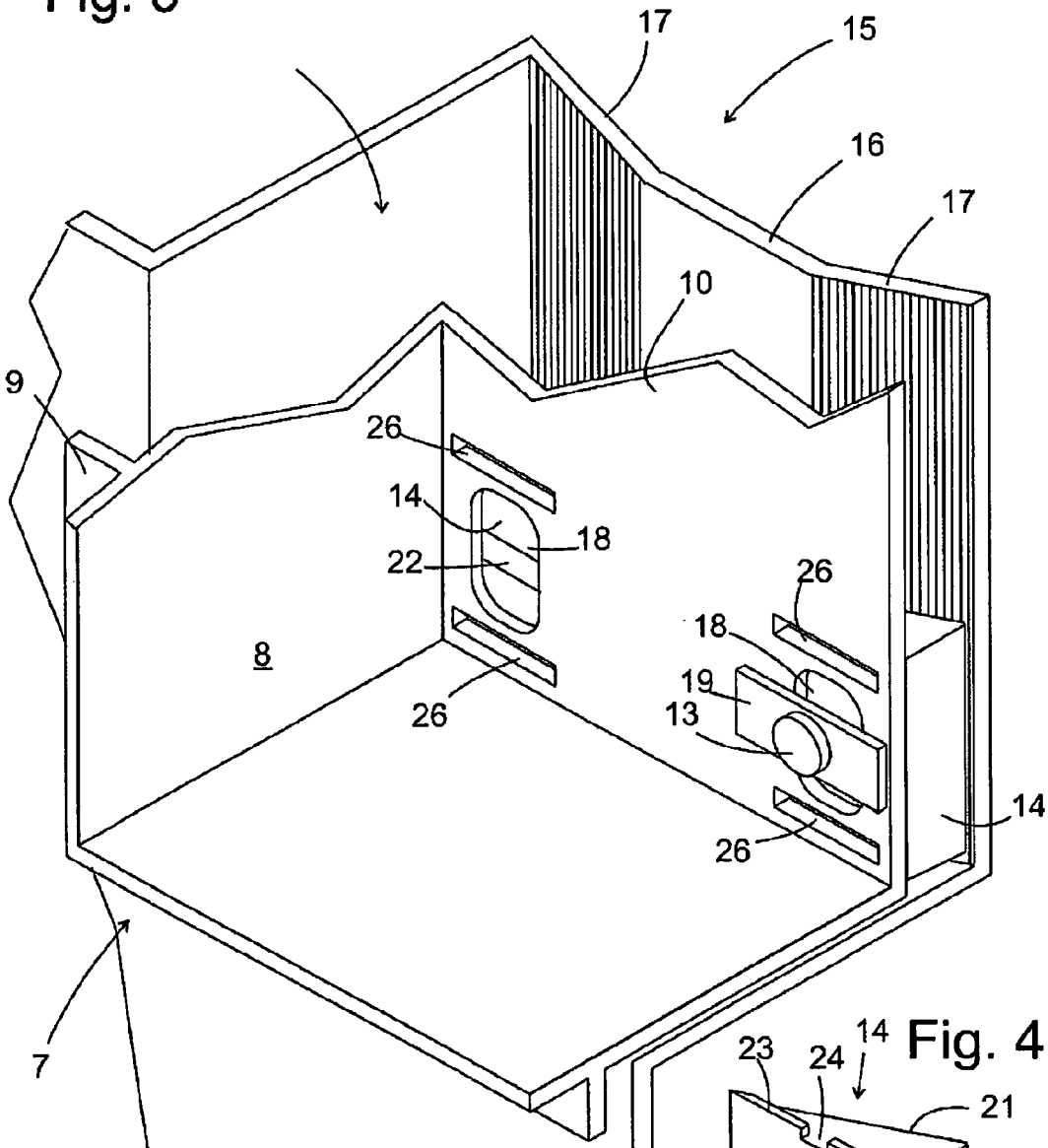
FIG. 3 is a fragmentary perspective view of the recess and the case of the refrigerator in the installed condition.

How the adapter 7 is fastened in the recess 3 can be seen more clearly in FIG. 3, which presents a fragmentary perspective view of the adapter 7 and the recess 3 accommodating the adapter. As can be seen in this drawing, the rear wall 15 of the recess 3 is arched in a horizontal cross section and has a middle section 16 which is parallel to the rear wall 10 of the adapter 7 and two side sections 17 which extend to the sides away from the rear wall 10. The side sections 17 have a corrugated surface with numerous vertical grooves.

In FIG. 3 one of the already mentioned four screws 13 is shown which is inserted through a slot 18 in the bottom right-hand corner of the rear wall 10. There is a corresponding slot 18 in the bottom left-hand corner of the rear wall 10 and in the top corners of the rear wall 10 which are not shown in FIG. 3. The vertical and horizontal dimensions of the slots 18 roughly correspond to the freedom for adjustment of the decorative panel 5 in relation to the door 2 and are considerably bigger than the heads of the screws 13. To prevent the screws from passing through the slots 18 they are each fitted with a rectangular washer 19 whose width is big enough to ensure that in each possible position of the screws 13 in their slots both ends of the washers 19 rest on the rear wall 10. In this way the screws 13 and the slots 18 make it possible to position the adapter 7 in the recess 3 variably in the height and width direction of the body 1.

Figure 4:
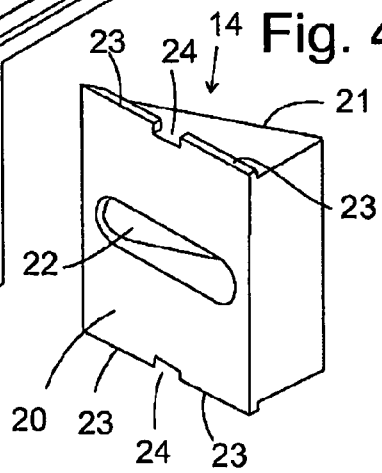
FIG. 4 is a perspective view of a wedge for clamping between the recess and the case in FIG. 3.

Between the rear wall 10 of the adapter 7 and the side sections 16 of the rear wall of the recess 3 a wedge 14 is placed at the level of each slot 18. FIG. 4 shows a perspective view of one of these wedges. The wedge has a flat front side 20 facing the rear wall 10 and a rear side 21 which is corrugated complementarily to the side sections 16 so that in each case a projection of the rear side 21 of the wedge 14 can engage in a recess of the side section 16. As a result, the wedge 14 is fastened in sideways direction when it is clamped between the rear walls 10 of the adapter 7 and 15 of the recess 3 by a screw 13.

The screw 13 is inserted through a slot 22 of wedge 14 extending in horizontal direction. The size of the slot 22 in horizontal direction is bigger than that of the slot 14 in order not to restrict the adjustability of the adapter 7 in sideways direction and to permit adjustability of the wedge 14 in sideways direction in relation to both the adapter 17 and the recess 3.

Figure 5:
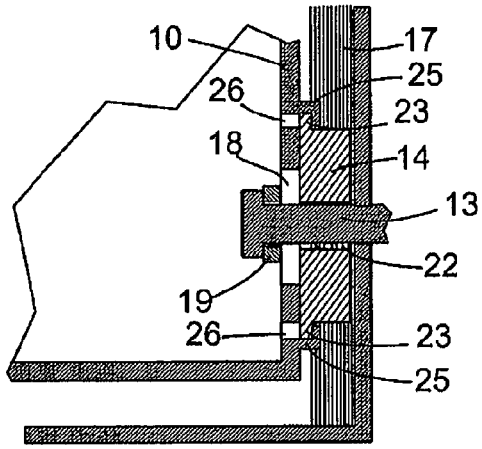
FIG. 5 is an enlarged cross section through the wedge and its surrounding area.

On the top and bottom sides of the wedge 14 in each case two narrow rims 23 are formed which are separated from each other by a notch 24. As can be seen in the cross-sectional drawing in FIG. 5, these rims 23 engage in grooves facing each other on the rear side of the rear wall 10. In order to be able to form angled profiles 25 bounding these grooves simply in one piece with the rest of the rear wall 10, narrow horizontal slits 26 are formed in the rear wall at the level of the angled profiles 25 through which during injection molding of the adapter 7 projections of a mold protrude through the wall 10. The slits 26 not only make it easier to mold the adapter 7 but also make it possible to position the wedges 14 between the rear walls 10, 15 in width direction when the adapter 7 has already been inserted in the recess 3. All that is needed for this is to insert a tool with a tip like a screwdriver through one of the slits 26 into the notch 24 of the wedge 14 located behind it. By moving the wedges it is possible to adjust the adapter 7 in the depth direction of the body 1.

Figure 6:
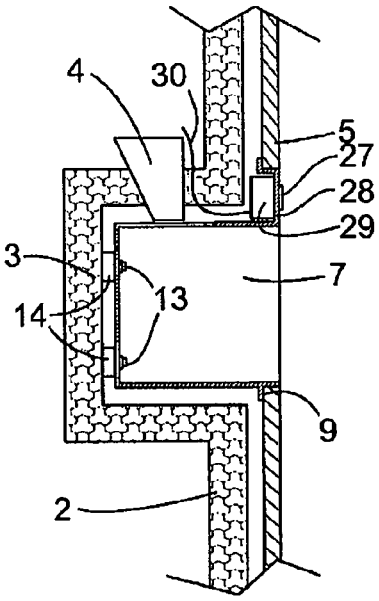
FIG. 6 is a cross section analogous to FIG. 2 in accordance with a second configuration of the invention.

FIG. 6 shows a cross section analogous to FIG. 2 in accordance with a second configuration of the invention. The adapter 7 is fastened in the recess 3 in the same way as for the configuration in FIG. 1 to 5 and this is not described again. The difference between the two configurations is that in the configuration shown in FIG. 6 the cutout 6 of the decorative panel 5 is significantly bigger in vertical direction than in FIG. 2 and that on the adapter 7 above the case 8 a plate 27 is formed to be placed flush with the front side of the decorative panel 5 on which the control and display elements such as buttons 28 to activate the dispensing of water or ice, or lights to display the functional readiness of the ice and/or water dispenser are located. An electronic module 29 attached behind the plate 27 which produces the display signals and which converts user inputs into control signals for the ice maker and/or the water dispenser is connected to the ice maker and/or water dispenser by a flexible cable 30 which is able to follow an adjustment movement of the decorative panel 5 or of the adapter 7 in relation to the door 2.

Figure 7:
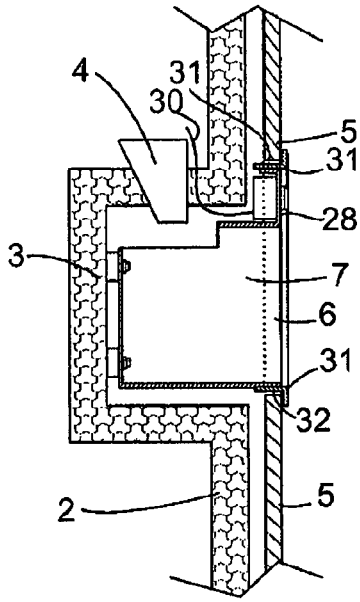
FIG. 7 is a cross section analogous to FIG. 2 in accordance with a third configuration of the invention.

A further configuration is shown in FIG. 7 in a cross section analogous to FIG. 2. Once again the suspension of the adapter 7 in the recess 3 is the same as in the configurations described above. The rim 9 around the case 8 is not present in this configuration. Instead, the case 8 is surrounded by a frame 31 placed on it whose four sides are formed in each case by cross-sectionally L-shaped profiles. The frame 31 frictionally encompasses the adapter 7 and a gap 32 between the edges of the cutout 6 of the decorative panel 5 and the legs of the frame 31 engaging in the cutout 6 is concealed to the outside by the other legs of the frame 31 resting on the outside of the decorative panel 5. This configuration makes it possible to compensate production tolerances in the dimensions of the cutout 6. Moreover, it can be used with decorative panels 5 of different thicknesses.

Figure 8:
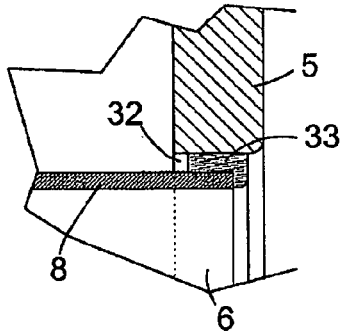
FIG. 8 is an enlarged detail in accordance with a fourth configuration of the invention.

A third configuration is explained in FIG. 8 using an enlarged partial cross section. The figure shows a cross section through an edge area of the cutout 6 and of the case 8 of the adapter 7 which engages in the cutout 6. In this configuration too no rim 9 is provided, so that the case 8 can be placed essentially freely in the depth direction in relation to the decorative panel 5. Here too the case 8 is surrounded on all four sides by a frame 33 which, however, does not protrude out onto the front side of the decorative panel 5 but merely fills the gap 32 between the edge of the decorative panel and the case 8.

Figure 9:
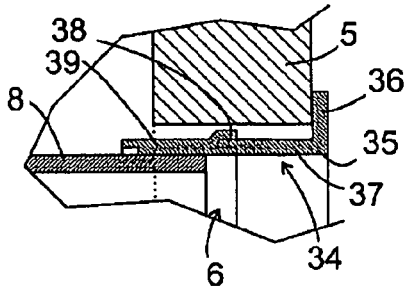
FIG. 9 is the same enlarged detail in accordance with a fifth configuration of the invention.

A configuration which is well suited for use with decorative panels 5 of considerably different thickness is shown in FIG. 9 in a cross section analogous to FIG. 8. Here the problem arises that if the adapter 7 does not engage deeply enough in the recess 3 it can become impossible to fill a container because the dispensing device 4 no longer hits it, but on the other hand it is desirable to be able to cover the edges of the opening 6 of the decorative panel 5. As in FIG. 7 a frame 34 is frictionally placed on the case 8 and an outer frame piece 35 of the frame 34 is formed or assembled as one piece from cross-sectionally L-shaped profiles which in each case exhibit an outer leg 36 resting on the outside on the decorative panel 5 and covering the gap 32 and an inner leg 37 engaging in the cutout 6. The inner leg 37 has a tongue 38 on its inner end which engages in a groove of an extension ring 39 in a positive and frictional connection. A corresponding tongue 38 is formed on the opposite end of the extension ring 39 so that if necessary a further, identical extension ring not shown here can be placed on the extension ring 39. According to the thickness of the decorative panel 5 as many extension rings 39 are added to the frame piece 35 as are needed to create a continuous connection between the decorative panel 5 and the case 8.

The invention claimed is:

1. A refrigerator comprising:

a housing having a front-side recess;

a dispensing device in the front-side recess of the housing, the dispensing device dispensing chilled items;

an adjustable decorative panel, the adjustable decorative panel at least partially covering the front side of the housing and the adjustable decorative panel having a recess opening via which the recess is accessible; and a case open towards the dispensing device and open towards the recess opening of the adjustable decorative panel, the case is adjustably secured in the front-side recess of the housing.

2. The refrigerator as claimed in claim 1, wherein the case in the recess is fastened by means of screws inserted in a slot in a wall of the case which engage in a thread in a wall of the recess opposite said wall of the case.

3. The refrigerator as claimed in claim 2, wherein the screws are inserted in the slots with play in two directions which are orthogonal to each other and clamp the wall of the case between said wall of the recess and a washer.

4. The refrigerator as claimed in claim 1, wherein the walls of the case and the recess run towards each other at an acute angle and a wedge is clamped between the walls.

5. The refrigerator as claimed in claim 4, wherein at least one surface of the wedge and a surface touched by it of one of the walls are complementarily toothed.

6. The refrigerator as claimed in claim 4, wherein the wedge exhibits a drilled hole into which one of the screws is inserted.

7. The refrigerator as claimed in claim 4, wherein the wedge is rail-guided on one of the walls.

8. The refrigerator as claimed in claim 7, wherein the wall on which the wedge is rail-guided is the wall of the case.

9. The refrigerator as claimed in claim 4, wherein the wall of the case exhibits an opening through which the wedge is accessible so that it can be moved.

10. The refrigerator as claimed in claim 1, wherein the walls are rear walls of the recess and of the case.

11. The refrigerator as claimed in claim 1, wherein the case engages in the opening of the decorative panel.

12. The refrigerator as claimed in claim 11, wherein the case is supported on the opening of the decorative panel.

13. The refrigerator as claimed in claim 11, wherein a gap between edges of the opening of the decorative panel and the area of the case engaging in the opening is filled by an inserted frame.

14. The refrigerator as claimed in claim 1, wherein a frame is fastened on the case and covers an edge area of the decorative panel surrounding the opening.

15. The refrigerator as claimed in claim 13, wherein the frame is composed of several rings arranged consecutively in the depth direction of the recess.

16. The refrigerator as claimed in claim 1, wherein the control elements of the dispensing device are integrated in the case.

17. The refrigerator as claimed in claim 4, wherein the case engages in the opening of the decorative panel.

18. The refrigerator as claimed in claim 17, wherein the case is supported on the opening of the decorative panel.

19. The refrigerator as claimed in claim 17, wherein a gap between edges of the opening of the decorative panel and the area of the case engaging in the opening is filled by an inserted frame.

20. The refrigerator as claimed in claim 19, wherein the frame is composed of several rings arranged consecutively in the depth direction of the recess.

* * * * *